United States Patent [19]

Buril

[11] 4,015,809

[45] Apr. 5, 1977

[54] HANGER DEVICE

[76] Inventor: Robert T. Buril, 413 Wacouta St., St. Paul, Minn. 55101

[22] Filed: Apr. 24, 1975

[21] Appl. No.: 571,071

[52] U.S. Cl. ..... 248/217.2; 248/218.4

[51] Int. Cl.[2] ..... E04G 3/00

[58] Field of Search ..... 248/216, 217, 219, 220, 248/DIG. 3, 223, 221, 227, 303; 211/54, 57, 59

[56] References Cited

UNITED STATES PATENTS

| | | | |
|---|---|---|---|
| 283,280 | 8/1883 | Richards | 248/219 |
| 1,015,213 | 1/1912 | Shands | 248/219 |
| 3,070,339 | 12/1962 | Schayer | 248/DIG. 3 |
| 3,127,144 | 3/1964 | Warner | 248/216 |
| 3,186,560 | 6/1965 | De Cristino | 248/DIG. 3 |
| 3,198,469 | 8/1965 | Callanan | 248/DIG. 3 |
| 3,409,260 | 11/1968 | Bleed | 248/216 |
| 3,799,357 | 3/1974 | Govang | 248/DIG. 3 |

FOREIGN PATENTS OR APPLICATIONS

| | | | |
|---|---|---|---|
| 433,468 | 8/1935 | United Kingdom | 248/219 |
| 777,254 | 6/1957 | United Kingdom | 248/303 |

*Primary Examiner*—Robert A. Hafer
*Attorney, Agent, or Firm*—Merchant, Gould, Smith, Edell, Welter & Schmidt, P.A.

[57] ABSTRACT

A bail member has laterally spaced arm portions and a bight portion connecting the arm portions together at one end. A securing means at the other end of the arm portions is provided for penetrating the sides of a stud or joist when the stud or joist is partially embraced by the bail member. An article supporting member has a cantilevered portion extending in a direction generally oppositely from the arm portions and a depending leg at one end of the cantilevered portion which operatively engages the bight portion centrally between the arm portions of the bail member. The arm portions of the bail member are so dimensioned and positioned as to dispose the securing means in different vertically and horizontally extended planes.

4 Claims, 8 Drawing Figures

HANGER DEVICE

BACKGROUND OF THE INVENTION

1. Field of the Invention

Present building costs and the pressure for more living space has forced the need for compact orderly storage space. The need to store cars, boats, snowmobiles and large powered lawn and garden tools have rendered garage storage space at a premium. The greater use of garage storage space has resulted in an overflow of articles to be stored into attic and basement storage spaces, however, wall storage of such articles is a more practical answer to this problem.

2. Description of the Prior Art

A variety of prior art hanger devices have been developed to provide ready wall storage. Possibly the most popular of these hanger devices are pegboard systems formed of wire-like hangers which are adapted to be detachably secured in perforations formed in composition wallboard. The wallboard is in turn secured to vertical studs of a wall structure. However, this type of device is costly, difficult to transport, install and relocate. Further, the amount of items are not only limited by the size of the pegboard but fixture hooks have a tendency to pull out when attempts are made to hang relatively heavy objects from the hooks. Thus, size and weight capabilities as well as strength and durability factors of pegboard systems are definite detriments. Other known hanger devices often are overly complicated relatively expensive structures not adaptable to all conditions of use which may be present.

SUMMARY OF THE INVENTION

The present invention pertains to a hanger device for use on vertical studs or horizontal joists of wall structures or other supporting structures, and includes a bail member having laterally spaced arm portions and a bight portion connecting one end of the arm portions. Securing means are positioned adjacent the other end of each of the arm portions for securing the arm portions. An article supporting member has a cantilevered portion extending in a direction generally oppositely from the arm portions and a depending leg portion at one end thereof which operatively engages the bight portion generally centrally between the arm portions to support the cantilevered arm portion in it's operative position.

BRIEF DESCRIPTION OF THE DRAWINGS

Referring to the drawings, wherein like characters indicate like parts throughout the figures.

DESCRIPTION OF THE PREFERRED EMBODIMENTS

Figure 1:
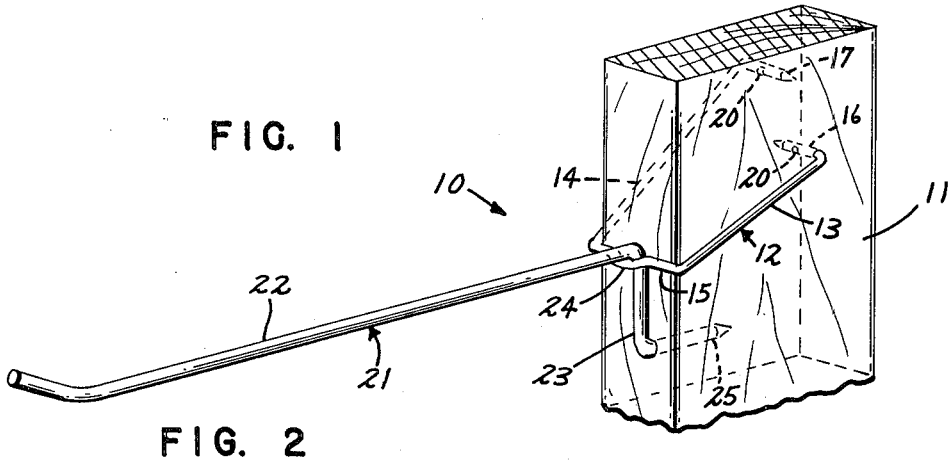
FIG. 1 is a view in perspective of a first embodiment of the present invention showing an operative position thereof on a vertical stud.
Figure 2:
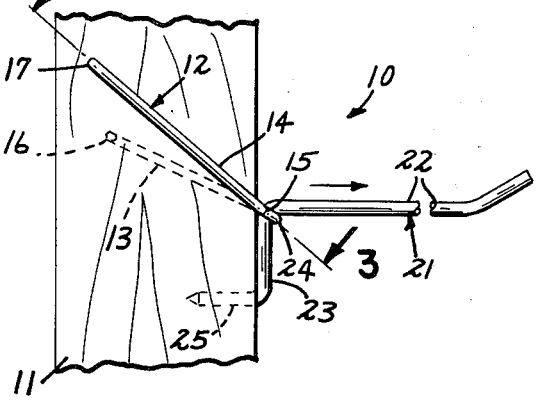
FIG. 2 is a view in side elevation thereof.
Figure 3:
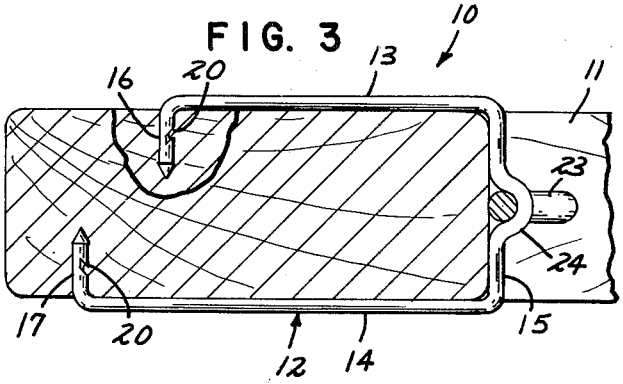
FIG. 3 is an enlarged sectional view as seen generally from the line 3—3 of FIG. 2, portions thereof being broken away and shown in section.

Referring first to FIGS. 1–3, the reference numeral 10 generally indicates a first embodiment of a hanger device utilized to support various articles, not shown, from vertical studs 11 generally associated with a supporting wall structure of a garage or the like, also not shown. Hanger device 10 includes a bail member 12 having laterally spaced arm portions 13, 14 and a bight portion 15 connecting the arm portions 13, 14, together at one end to extend therefrom in generally the same direction. As shown in FIG. 1, securing means for securing the arm portions 13, 14 to the sides of the stud 11 when the arm portions 13, 14 at least partially embrace the stud 11, include a pair of inwardly projecting spike elements 16, 17. The spike elements 16, 17 are mounted one each on the other or free ends of each of the arms 13, 14 respectively. Each of the spike elements 16, 17 is provided with a slot-like notch 20 formed on the bias with respect to the longitudinal axis of a respective spike element 16, 17 so as to open generally toward a respective arm portion 13, 14. Thus, as can be seen in FIG. 3 of the drawings when the spike elements 16, 17 penetrate the sides of the stud 11, small portions of the stud 11 enter the notches 20 making it difficult for the spikes 16, 17 to withdraw from the stud 11. In place of the slots 20, each spike elements 16, 17 may be coated with a suitable resin to securely anchor the spikes 16, 17 to the stud 11. As shown in FIGS. 2 and 3, arms 13 and 14 define respectively with bight portion 15 a pair of first planes which preferably intersect, along bight 15 as a vertex, at a small diahedral angle, although the planes may coincide if desired.

Hanger device 10 also includes an article supporting member 21 having a cantilevered portion 22 which extends generally horizontally in a direction generally oppositely from the arm portions 13, 14 and an integral downwardly depending leg portion 23 at one end thereof. The leg portion 23 operatively engages the bight portion 15 generally centrally between the arm portion 13, 14. As shown, in FIG. 1 and 3, the bight portion 15 is formed with a saddle portion 24 to maintain the central engagement of the leg portion 23 with the bight portion 15 while allowing a major portion of the bight portion 15 to engage the adjacent portion of the stud 11. As seen particularly in FIG. 1 and 2 of the drawings, the bight portion 15 engages the support member 21 at the juncture of the horizontal cantilevered portion 22 and the downwardly depending leg portion 23 on the side defining an included angle between portions 22 and 23. Thus, the cantilevered portion 22 projects from the leg portion 23 above the level of the bight portion 15.

For reasons which will become apparent hereinafter, the bail member 12 is operatively positioned with bight 15 generally orthogonal with respect to a second plane defined by the cantilevered portion 22 and the depending portion 23. In the specific example illustrated, the bail member 12 is separable from the supporting member 21, at least one of the arm portions 13, 14 can be positioned to have an upward angle of inclination relative to the horizontal, so that a respective spike element 16, 17 will be disposed above the level of the bight portion 15 when the hanger device 10 is operatively mounted, see FIG. 2. Preferably, the arms 13, 14 are inclined upwardly with different inclinations whereby to position the spike elements 16, 17 in different vertically and horizontally extended planes so that the spikes 16, 17 penetrate the stud 11 in different vertically and horizontally extended planes to prevent cracking or damage to the stud 11.

The distal end of the downwardly depending leg portion 23 is formed with a spike-like foot portion 25 projecting oppositely from and generally parallel to the cantilevered portion 22 whereby to penetrate a stud 11 on which the hanger device 10 may be mounted. While maintaining the leg portion 23 in contact with the adjacent face of the stud 11 substantially along its entire length to provide a required support to the cantilevered portion 22.

To mount the above described structure to a stud 11, the article supporting member 21 is first positioned as in FIGS. 1–3 by driving the spike-like foot 25 into the stud 11. Thereafter, the bail member 12 is positioned with the arms 13, 14 on opposite sides of the stud 11 and with the leg portion 23 received within the saddle portion 24 generally at the juncture of the cantilevered arm portion 22 and leg portion 23. In this position the cantilevered portion 22 projects from the leg portion 23 above the level of the bight portion 15, so as to take optimum advantage of the support afforded by bight portion 15. The angle of inclination of the bail member 12 is now adjusted to position the spike elements 16, 17 in different vertically and horizontally extended planes and to provide an optimum position to resist forces tending to displace the article supporting member 21 from its article supporting position of FIGS. 1 and 2. As can be seen in FIG. 2, the downward force of an article supported by the cantilevered portion 22 tends to pivot the article supporting member 21 at a fulcrum defined by the juncture of the leg portion 23 and the foot element 25. This exerts a force generally longitudinally of the cantilevered portion 22 as indicated by the arrow in FIG. 2. It will be noted that positioning the spike elements 16, 17 at or below the level of the bight portion 15 would result in a tendency for the bight portion 15 to be forced downwardly on the leg portion 23 when a downward force is applied to the cantilevered portion 22. This, of course, would cause failure of the hanger device 10. It will also be noted, that one of the arm portions 14 is longer than the other of the arm portions 13. This further aids in positioning of the spike elements 16, 17 in different vertically and horizontally extended planes as well as positioning of the bail member 12 under conditions which will become apparent in relationship to the description of the structures of FIGS. 4 and 5. It will be further noted, that all of the components of the hanger device 10 are formed from rod-like material to reduce manufacturing expenses. However, it will be seen that the transverse cross-sectional area of the article supporting member 21 is substantially larger than that of the bail member 12 because of the particular stresses applied to each of the members 12, 21.

Figure 4:
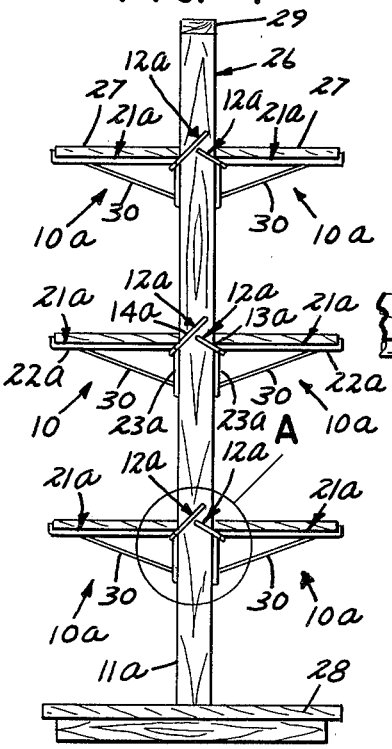
FIG. 4 is a view in end elevation of a gondola type display shelf utilizing a second embodiment of the present invention for supporting the shelves thereof.
Figure 5:
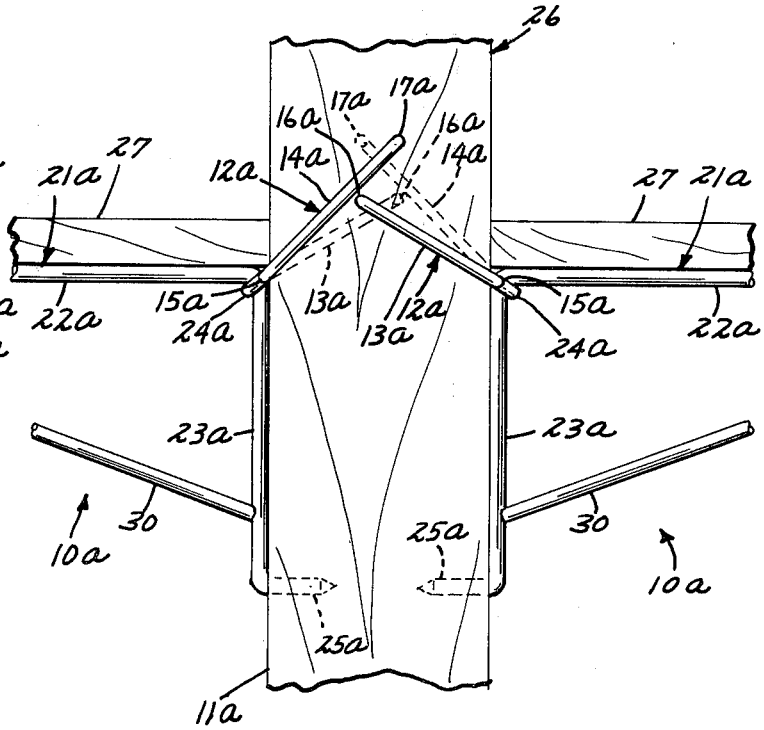
FIG. 5 is an enlarged detailed elevational view of that portion of FIG. 4 contained within the circle A.

Referring now to FIGS. 4 and 5, wherein like parts will carry like numerals with the letter *a* added, a second embodiment of a hanger device 10*a* is illustrated. As shown, a plurality of hanger devices 10*a* are positioned on a vertical support or stud 11*a* of a gondola type display shelf unit 26. As shown, cantilevered arms 22*a* of pairs of hanger devices 10*a* are disposed to project from opposite edges of the stud 11*a* to support pairs of shelves 27 at substantially identical levels. The support or stud 11*a* is mounted to extend vertically upwardly from a relatively flat base 28 and spaced ones of the supports 11*a*, one of which is shown, are tied together at their upper ends by the tie member 29.

The hanger device 10*a* differs from the hanger device 10 only in that the downwardly depending leg portion 23*a* is slightly longer and that a supporting strut extends between the leg portion 23*a* and the cantilevered portion 22*a*. The connection of the strut 30 to leg portion 23*a* and cantilevered portion 22*a* is spaced from the juncture of the portions 23*a* and 22*a*. As seen particularly in FIG. 5, because the hanger devices 10*a* are mounted directly opposite each other on the stud 11*a*, the bail members 12*a* would normally interfer with each other if the arm portions 13, 14 of each of the adjacent bail members 12*a* were of equal length. However, because one of the legs 13*a* is shorter than the other leg 14*a* of each of the bail members 12*a*, the leg 14*a* of one bail member 12*a* does not interfer with the leg 13*a* of the other bail member 12*a*. This allows the bail members 12*a* to be positioned at a desired degree of inclination as above described. A spike-like foot member 25*a* likewise stabilizes the article supporting member 21*a* of each hanger device 10*a*.

Figure 6:
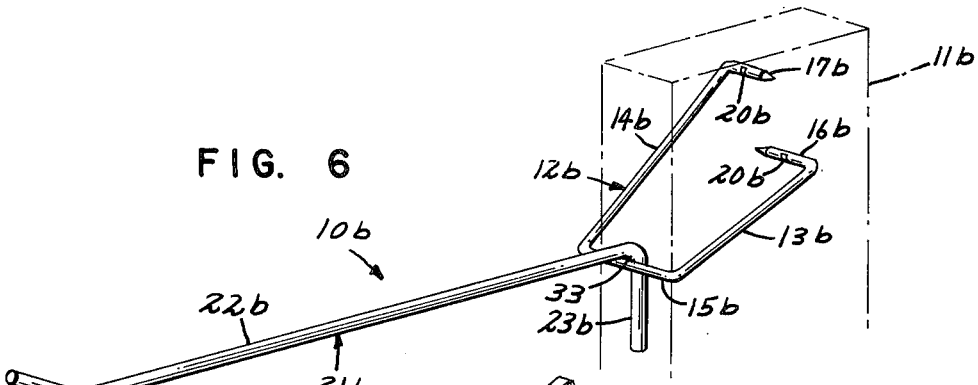
FIG. 6 is a view in perspective of a third embodiment of the present invention.

FIG. 6 of the drawings illustrates a third embodiment 10*b* of the invention, wherein like parts carry like numerals with the letter *b* added. Hanger device 10*b* is substantially identical to hanger device 10 except that the article supporting member 21*b* is fixidly attached by welding or the like, as at 33. That is, the article supporting member 21*b* is fixidly attached to the bight member 15*b* of bail member 12*b* at the juncture of the cantilevered portion 22*b* and the downwardly depending leg portion 23*b*. Because the article supporting member 21*b* is fixedly attached to the bight portion 15*b* a stabilizing spike-like foot portion is not needed at lower end of the downwardly depending leg portion 23*b*. Also, because the article supporting member 21*b* is fixidly secured to the bail member 12*b* the optimum degree of inclination of the arms of the bail member 12*b* must be preselected prior to assembly of the hanger device 10*b*.

Figure 7:
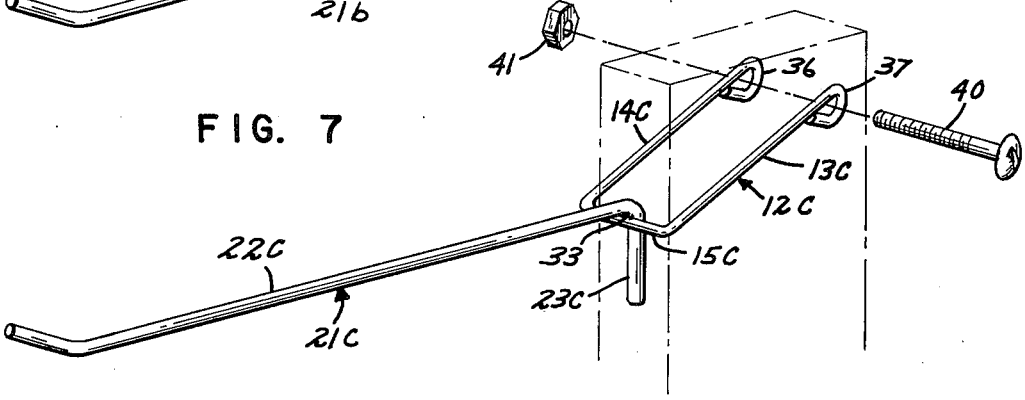
FIG. 7 is a view in perspective of a fourth embodiment of the present invention.

FIG. 7 of the drawings illustrates a forth embodiment of the present invention, wherein like parts thereof are indicated by like numerals with the reference letter *c* added. In this embodiment, the hanger device 10*c* differs from the hanger 10*b* in that the bail member 12*c* includes arm portions 13*c*, 14*c* which are of equal length and incline upwardly at common degrees of inclination from the horizontal. Also, the securing means differs from the structure of FIG. 6 in that the spike portions 16*b*, 17*b* of the hanger device 10*b* are eliminated and aligned eye portions 36, 37 are formed on the free ends of the arm portions 13*c*, 14*c* respectively. Separate securing elements in the nature of a bolt 40 and nut 41 are provided. The bolt 40 is received through the aligned eye portions 26, 37 and through an opening, not shown, but formed in a stud 11*c*. The nut 41 may be threadly engaged on the bolt 40 to hold the unit securely in place. While I have shown a nut and bolt arrangement for securing the bail 15*c* to the stud 11*c*, it will be appreciated that other securing devices such as nails or screws may be used to secure the eye portions 36, 37 to the stud 11*c*. Also, it will be appreciated that the bail member 10*c* could be constructed so that the arms 13*c*, 14*c* would have different degress of inclination relative to the horizontal so that the nails or screws, not shown, would penetrate the stud 11*c* at points in different vertically and horizontally extended planes in the manner illustrated in FIGS. 1–6. Further, it is noted that the projecting leg portions 23-23*c* all are operatively disposed between the respective bight portions 23-23*c* and a stud 11-11*c* on which each of the hanger devices 10-10*c* is to be mounted. Thus, in each case the full force of a load carried by the article supporting member 21-21*c* is carried by the bail member 12-12*c* without depending solely on welded joints or the like.

Figure 8:
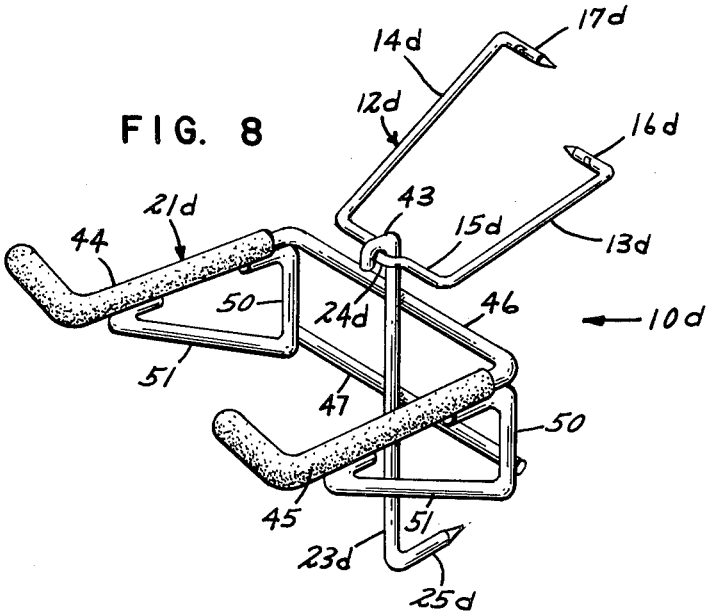
FIG. 8 is a view in perspective of a fifth embodiment of the present invention.

Finally, FIG. 8 illustrates a fifth embodiment of the present invention, wherein like parts are indicated by like numerals with the letter *d* added. In this embodiment a hanger device 10*d* is shown which is constructed to accommodate relatively heavier articles. As such, downwardly depending leg portion 23*d* is formed at one end to provide a downwardly opening hook portion 43 which at least partially encircles the bight portion 15*d* of the bail member 12*d* at the saddle portion 24*d*. The other end of the leg portion 23*d* is formed with a spike-like foot portion 25*d* for penetration of a stud on which the hanger device 10*d* is to be mounted.

Because the anchor device 10*d* is meant to support heavier loads, the articles supporting member 21*d* is constructed to provide this additional support. In this respect, the supporting member 21*d* includes a pair of laterally spaced horizontal cantilevered arms 44, 45 and a first connecting portion 46 connecting common ends of the arms 44, 45 together. The leg portion 23*d* is fixedly secured to the first connecting portion 46 generally centrally between the laterally spaced horizontal arms 44, 45. A second connecting portion 47 is affixed to the downwardly depending leg portion 23*d* in downwardly spaced relation to the first connecting portion 46. The second connecting portion 47 is of equal length and generally parallel to the first connecting portion 46, and has opposite ends which terminate in line with and below the level of the arms 44, 45.

A pair of supporting brackets 49 each include a vertically extended portion 50 extending between each opposite end of the second connecting portion 47 and the first connecting portion 46 and an angularly extending portion 51 which extends between each opposite end of the second connecting portion 47 and an adjacent one of the laterally spaced arms 44, 45. The point of connection of each of the angularly extending portions 51 to it's respective arm 44, 45 is spaced from the first connecting portion 46. In the case of the hanger device 10*d*, the article supporting member 21*d* differs from the abovedescribed structures in that it is supported from the laterally projecting leg 23*d* below the level of the bight portion 15*d* of the bail member 21*d*. Thus, on occasion, it may be desired to eliminate the spike-like foot 25*d* since the article supporting member 21*a* would then self-center itself relative to the weight mass of the article being suspended much in the manner of a pendulum.

For illustrative reasons, I have illustrated my hanger devices 10-10*d* as mounted on vertical studs. However, it will be appreciated by those skilled in the art that hanger device 10 may be likewise mounted on horizontal joists, not shown, with the cantilevered portion 22 extending in a generally vertical direction. In this application, the cantilevered portions 22 of a spaced pair of hanger devices 10 may be each provided with a loop or the like, also not shown for the reception of an opposite end of a bar in each loop. Also, a loop on a single hanger device 10 may have an article hung therefrom for storage. Of course, when the hanger device 10 is mounted on a horizontal joist, it will be appreciated that the angle of inclination of arm portions 12, 14 relative to the longitudinal axis of cantilevered portion 22 should be minimized to provide a more stable condition or support for the article supporting member 21.

What is claimed is:

1. A hanger device for securement at an edge of a timber of known thickness, comprising a support member and a bail member;

said support member being of rod-like material and comprising a leg portion, for longitudinally engaging said edge of said timber, and a cantilever portion substantially perpendicular to said leg portion;

and said bail member being of rod-like material and comprising a pair of spaced arm portions including opposite ends, said arm portions being interconnected at first ends by a bight portion;

said arm portions extending in the same general direction from said bight portion, and being provided at second ends with securing means for fastening said bail member to the faces of said timber at locations spaced from said edge, and said bight portion comprising a saddle portion between two aligned lateral portions, said saddle portion offsetting in a direction generally opposite to the general direction of said arm portions by an amount generally the same as the size of said leg portion of said support member, so that when said saddle member engages said leg portion, said linear portions can engage the surface of said edge of the timber, wherein said cantilever portion includes a pair of laterally spaced horizontal arms and a connecting portion connecting common ends of said pair of arms together, said downwardly depending leg portion being fixedly secured to said first connecting portion generally centrally between said lateraly spaced horizontal arms.

2. The structure of claim 1 wherein said hanger device includes a second connecting portion affixed to said downwardly depending leg portion in downwardly spaced relation to said first connecting portion, said second connecting portion being of substantially equal length and extending generally parallel to said first connecting portion and having opposite ends, a pair of supporting brackets, each bracket of said pair of supporting brackets being connected to and extending between one of said opposite ends of said second connecting portion and an adjacent end of said first connecting portion and extending between a respective one of said opposite ends of said second connecting portion and a point on an adjacent one of said laterally spaced cantilevered arms in spaced relation to said first connecting portion.

3. A hanger device for securement at an edge of a timber of known thickness, comprising a support member and a bail member;

said support member being of rod-like material and comprising a leg portion, for longitudinally engaging said edge of said timber, and a cantilever portion substantially perpendicular to said leg portion;

and said bail member being of rod-like material and comprising a pair of spaced arm portions including opposite ends, said arm portions being interconnected at first ends by a bight portion;

said arm portions extending in the same general direction from said bight portion, and being provided at second ends with securing means for fastening said bail member to the faces of said timber at locations spaced from said edge, and said bight portion comprising a saddle portion between two aligned lateral portions, said saddle portions offsetting in a direction generally opposite to the general direction of said arm portions by an amount generally the same as the size of said leg portion of said support member, so that when said saddle member engages said leg portion, said linear portions can engage the surface of said edge of the timber, wherein a strut element is connected to and extends between locations on said cantilevered portion and said depending leg portion which are in spaced relation to the juncture of said cantilevered portion and said depending leg portion.

4. A hanger device for securement at an edge of a timber of known thickness, comprising a support member and a separate bail member;

said support member being of rod-like material and comprising a leg portion, for longitudinally engaging said edge of said timber, and a cantilever portion substantially perpendicular to said leg portion, said leg portion terminating in a piercing point for penetrating the edge of the timber;

and said bail member being of rod-like material and comprising a pair of spaced arm portions including opposite ends, said arm portions being interconnected at first ends by a bight portion substantially perpendicular thereto and of length substantially the same as the thickness of the timber;

said arm portions extending in the same general direction from said bight portion, and being provided at second ends with securing means in the form of piercing points directed generally toward one another for fastening said bail member to the faces of said timber at locations spaced from said edge, and said bight portion comprising a saddle portion between two aligned lateral portions, said saddle portion offsetting in a direction generally opposite to the general direction of said arm portions by an amount generally the same as the size of said leg portion of said support member, so that when said saddle member engages said leg portion, said linear portion can engage the surface of said edge of the timber.

* * * * *